US009297134B1

(12) United States Patent
Dancer

(10) Patent No.: US 9,297,134 B1
(45) Date of Patent: Mar. 29, 2016

(54) SELF-EXPANDING BARRIER FOR CONTROL OF SURFACE WATER FLOW

(71) Applicant: Carol J. Dancer, Attleboro, MA (US)

(72) Inventor: Carol J. Dancer, Attleboro, MA (US)

( * ) Notice: Subject to any disclaimer, the term of this patent is extended or adjusted under 35 U.S.C. 154(b) by 0 days.

(21) Appl. No.: 13/730,662

(22) Filed: Dec. 28, 2012

Related U.S. Application Data

(60) Provisional application No. 61/596,248, filed on Feb. 8, 2012.

(51) Int. Cl.
*E02B 3/12* (2006.01)

(52) U.S. Cl.
CPC ..... *E02B 3/12* (2013.01)

(58) Field of Classification Search
CPC ..... E02B 3/208; E02B 3/126; E02B 3/127; E02B 7/00; E02B 3/108; E02B 3/12
USPC ..... 405/15–19, 63, 107, 111, 114, 115
See application file for complete search history.

(56) References Cited

U.S. PATENT DOCUMENTS

| | | | | |
|---|---|---|---|---|
| 3,538,711 | A * | 11/1970 | Nielsen | 405/23 |
| 4,966,491 | A * | 10/1990 | Sample | 405/19 |
| 5,158,395 | A | 10/1992 | Holmberg | |
| 5,906,572 | A * | 5/1999 | Holland | 588/255 |
| 6,524,670 | B1 | 2/2003 | Kataoka | |
| 6,783,300 | B2 | 8/2004 | Doolaege | |
| 7,258,904 | B2 | 8/2007 | Watanabe | |
| 7,329,069 | B2 | 2/2008 | Slater | |
| 7,357,598 | B1 | 4/2008 | Bradley | |
| 7,762,742 | B1 | 7/2010 | Smith | |
| 7,811,028 | B1 * | 10/2010 | de la Rosa et al. | 405/15 |
| 7,841,268 | B2 | 11/2010 | Bailey | |
| 8,088,279 | B2 * | 1/2012 | McInnis et al. | 210/170.03 |
| 2002/0081153 | A1 | 6/2002 | Genzel | |

(Continued)

FOREIGN PATENT DOCUMENTS

| | | | |
|---|---|---|---|
| JP | 61169509 | A | 7/1986 |
| JP | 62133204 | A | 6/1987 |

(Continued)

OTHER PUBLICATIONS

DeWitt. Knitted Shade Cloth. dewittcompany.com/products. Captured by the Wayback Machine on Jun. 19, 2011 and retrieved on May 2, 2015.*

*Primary Examiner* — Thomas B Will
*Assistant Examiner* — Jessica H Lutz
(74) *Attorney, Agent, or Firm* — C. Nessler

(57) ABSTRACT

A barrier for damming or channeling surface water flow is comprised of a non-woven polymer fabric sleeve within which is contained a water absorbent material which, upon contact with sufficient water, swells up to 20 or more times its initial weight. Preferred barriers have a D-shape front lobe and a rear lobe that inhibits overturning of the barrier during use. The water absorbent material is contained within a sheet that is captured by stitching which is the separator between the front and rear lobes. Barriers made of a dark color such as black or brown non-woven polypropylene fabric, and containing a super absorbent polymer (SAP), only minimally degrade in function when exposed to prolonged sunlight.

13 Claims, 5 Drawing Sheets

(56) References Cited

U.S. PATENT DOCUMENTS

| | | | | |
|---|---|---|---|---|
| 2008/0202073 | A1* | 8/2008 | Kim | 53/455 |
| 2010/0232882 | A1 | 9/2010 | Tasker | |
| 2011/0123271 | A1* | 5/2011 | Walthall | 405/114 |
| 2011/0165294 | A1* | 7/2011 | Versteylen et al. | 426/133 |
| 2011/0280660 | A1* | 11/2011 | Bahukudumbi et al. | 405/63 |
| 2011/0297575 | A1* | 12/2011 | Bouchard et al. | 206/524.3 |
| 2011/0311312 | A1* | 12/2011 | Bouchard et al. | 405/107 |
| 2012/0003049 | A1* | 1/2012 | Sprague et al. | 405/184.4 |

FOREIGN PATENT DOCUMENTS

| | | | | | |
|---|---|---|---|---|---|
| JP | 6375208 | A | | 4/1988 | |
| JP | 01021111 | | | 1/1989 | |
| JP | 6421111 | A | | 1/1989 | |
| JP | 03286010 | A | * | 12/1991 | E02B 3/04 |
| JP | 8134865 | A | | 5/1996 | |
| JP | 2001355219 | A | | 12/2001 | |
| KR | 20010062058 | | | 7/2001 | |
| WO | WO 2011/061539 | | * | 5/2011 | E02B 3/10 |

* cited by examiner

SELF-EXPANDING BARRIER FOR CONTROL OF SURFACE WATER FLOW

This application claims benefit of provisional patent application Ser. No. 61/596,248, filed on Feb. 8, 2012 and the disclosure thereof is hereby incorporated by reference.

TECHNICAL FIELD

The present invention relates to devices for controlling flow of surface waters, in particular for blocking the flow of flood waters.

BACKGROUND

Flooding from excess rain or overflowing of streams and other water courses is a recurring problem. In severe emergencies, hundreds of people may construct earthworks and fill, prepare, transport and place sand bags for area-protection. However, often an individual property owner may be left to his or her own devices, with limited means and equipment. One of the primary aims of owners of homes and small businesses is to prevent flood waters from entering a building. Stacking sand bags to build a retaining wall is a familiar approach. However, pre-filled sand bags are often not readily available; and it can be a labor intensive and time consuming process to set up and fill bags, or to move heavy bags from a location where they were previously stored.

Another aim, even in non-flood conditions, is to divert the flow of water to prevent erosion. For example, in times of severe precipitation excess sheet water flow may tend to erode a sloped driveway or a garden; thus an owner may want to divert the sheet flow by laying sandbags or another temporary barrier along the ground or driveway.

Smith U.S. Pat. No. 7,762,842 shows the use of a long flexible wall impervious tube which can be filled with water to create a tubular structure which is laid on the ground to dam surface water in substitution of a conventional sand bag. The tubular structure has a weighted flap attached to the front for both anchoring of the tube and preventing flow of water under the tube. A user must pre-fill the bag with water and lay it in position to block or divert surface water. A hose is inserted into an opening or spout, to fill the bag. Doing that presumes the availability of a pressurized water supply, which could be a problem.

Doolage U.S. Pat. No. 6,783,300 discloses a surface water damming device comprised of a water filled tube that is contained within a woven fabric that provides abrasion protection. Some embodiments comprise two or more lengthwise running lobes for stability against overturning force of the dammed water.

Kataoka U.S. Pat. No. 6,524,670 discloses a coarse jute fiber bag containing a polymer resin which swells upon contact with water. The resin is contained in a water soluble pouch which is placed within an envelope of permeable fabric such as jute, commonly a coarse woven fabric. When the bag is thoroughly wetted, the pouch dissolves and the resin reacts to contact by water by expanding, to create an expanded bag which the patent misnames a sand bag. In the background section of the Kataoka patent, certain Japanese patent publication prior art is discussed, including that bags have had water expanding resin loosely contained with the sack or that resin has been pre-placed within the sack between two water absorptive sheets.

There is a need for a compact, lightweight, easy to store and easy to activate system for preventing flow of surface water into buildings and other unwanted places, and for diverting the flow of water. The system should desirably provide functionality comparable to that which might be achieved by common sandbags.

SUMMARY

An object of the invention is to block or divert surface water flow with respect to selected places, using a means which effective in substitution of sand bags and the like that have been used in the past. Another object is to provide a system useful for resisting flood water intrusion into a building. A further object is to provide a water barrier system which is light in weight, compact in storage before use, easy to handle and install, and which can be tailored to different length and height needs. Further objects include providing a system which is strong and structurally stable during use; which is resistant to environmental degradation before during and after use, particularly due to the effects of sunlight; which minimizes any health or environmental hazards to users; and which is reusable.

In accord with an embodiment of the invention, a barrier is comprised of a water permeable sleeve, closed at both ends, within which is contained a selected quantity of water-absorbent substance, that is, a substance which greatly expands in volume and increases in weight upon contact with water. The water-absorbent substance is referred to often herein as simply "absorbent". The sleeve material is preferably one which stops transmission of sunlight sufficient to avoid substantial degradation of the water-absorbent substance during use of the barrier. Preferably the barrier comprises a sleeve made of a nonwoven thermoplastic fabric selected from the group comprising a fabric having a dark color, a fabric having a value of 2 or less on the Munsell color system scale, and a fabric which is black or brown in color.

Prior to use, an embodiment of invention barrier is substantially flat and light in weight and has a small cross section area cavity within which is contained water-absorbent substance. When contacted with water which penetrates the sleeve, the absorbent expands. In embodiments of the invention, the quantity of absorbent, preferably a Super Absorbent Polymer (SAP) type of material, is chosen so that upon expansion the volume of the cavity containing the absorbent will be less than the maximum volume of the sleeve, thus enabling the sleeve to have a flattened bottom or D-shape, that provides good resistance to flow of water under the barrier during use. In embodiments with D-shape cross section, the nominally flat portion of the barrier which contacts the support surface for the barrier is about one-third of the length of the cross-sectional periphery of the barrier; and the D-shape cross section portion of the barrier in the swelled up condition has an interior volume which is about 80 percent of the maximum interior volume of the barrier. Optionally, an apron is attached to the front of the barrier for hold-down purpose and for further inhibition of flow under the barrier.

In further accord with the invention, a barrier embodiment comprises two lengthwise sections or lobes, preferably formed by lengthwise stitching or other fastening of the fabric of the sleeve. A larger front lobe is connected to a smaller rear lobe at joint. The barrier thus has a width or lateral (front-back) dimension which is substantially greater than its vertical dimension. The shape and structural configuration helps the barrier resist the lateral rolling force which results from dammed water which presses against the exterior of the front lobe. The rear lobe presses against the surface upon which the barrier rests and provides a moment arm which resists the rolling or over-turning moment from the dammed water. In an embodiment of the invention, the rear lobe is about 20 percent of the width of the barrier. In another embodiment of the invention, there is a solid member, such as a plastic strip, attached to the rear of the barrier in substitution of the rear lobe. Barriers may have widths and different lengths, including lengths of about 1.5, 3 and 5 meters (5, 10 and 17 feet).

In embodiments of the invention, the water-absorbent substance is placed within a dry sleeve, preferably made of needle punched nonwoven polymer sheet, such as one made from polypropylene fiber material. The absorbent may be provided either as a particulate, preferably in a pouch, or as a component of a cellulosic fiber sheet. In the two lobe embodiment, the absorbent containing sheet is captured within the lengthwise stitching in a way which allocates the proper amounts of absorbent between the front and rear lobes.

In embodiments of the invention, after fabrication, a barrier is contained within a plastic envelope from which air has been partially evacuated, and that both compresses the barrier, making it compact for shipment, and avoids accidental contact with water.

The barriers of the present invention achieves the objects of the invention, including that they may be shipped in a flattened condition and easily stored and transported to the point of use. The barrier may be put in its use condition by wetting it in a variety of ways. A preferred barrier is durable in sunlight and after use may be allowed to dry over time, and then stored for re-use.

The foregoing and other objects, features and advantages of the present invention will become more apparent from the following description of preferred embodiments and accompanying drawings.

DESCRIPTION

An embodiment of the invention comprises a sleeve made of porous fabric material, such as a water-permeable nonwoven geotextile, within which is contained a substance that absorbs water upon contact and thus expands in volume, called here either a water-absorbent substance, a super-absorbent polymer (SAP), or more simply an absorbent.

Figure 1:
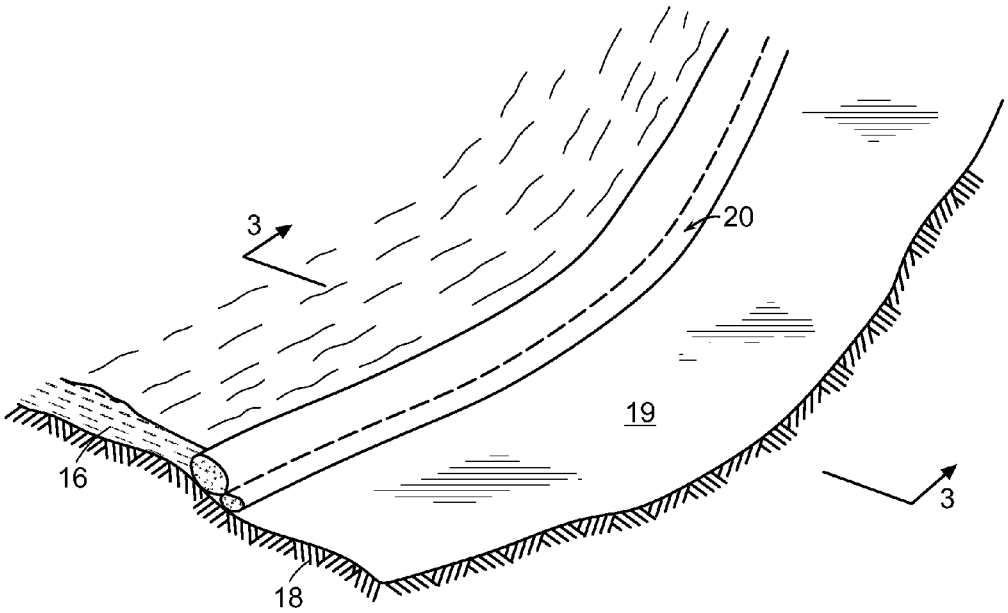
FIG. 1 is a perspective view of a two lobe barrier holding back surface water.
Figure 2:
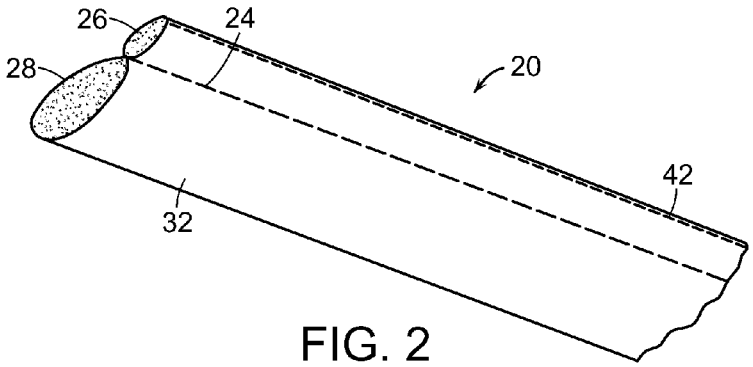
FIG. 2 is a perspective view showing the underside of part of a two lobe barrier in its swelled or use condition.
Figure 3:
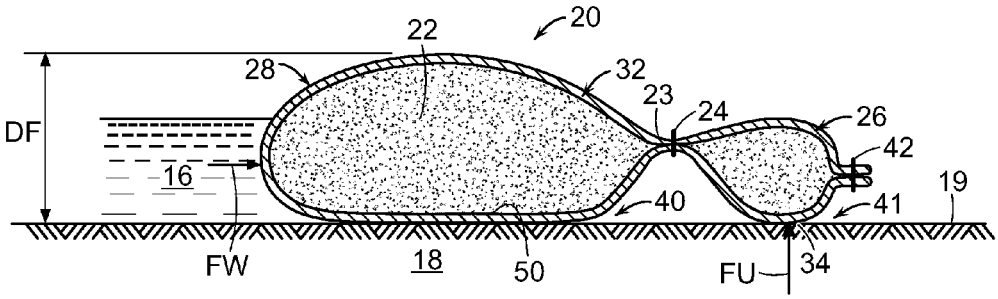
FIG. 3 is an end elevation view cross section of a two lobe barrier resting on a surface and holding back dammed water.

A barrier 20 is shown in use in the perspective view of FIG. 1, where it is lying on a surface 19 of earth 18, to contain water 16 which would otherwise spread further over the surface. The earth is used here as an exemplar for providing a support surface; and the barrier may be used on any supporting surface, including the floor of a building, a driveway, etc. FIG. 2 shows the barrier and its component parts, also in perspective, looking upwardly at the underside of the barrier as if suspended in space. FIG. 3 is a cross section through the in-use barrier of FIG. 1.

Figure 4:
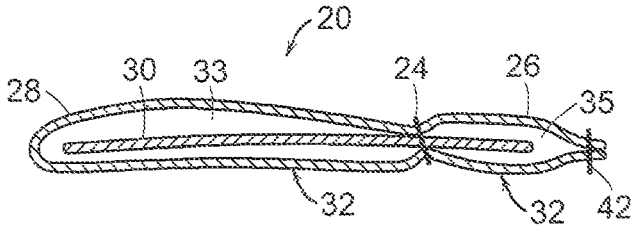
FIG. 4 is a cross section view of a two lobe barrier in dry condition, with water-absorbent containing sheet captured within the sleeve of the barrier made from a single sheet of sleeve material.
Figure 5:
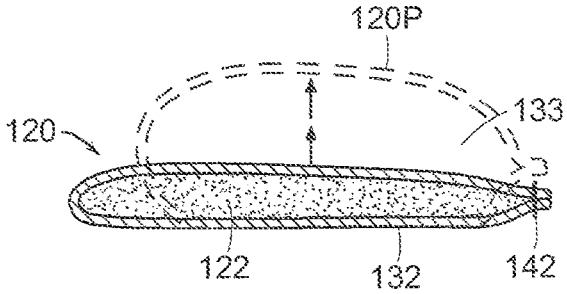
FIG. 5 is a cross section view of a one cavity barrier in dry flattened condition, showing in phantom how it swells to an oblong shape, for use.

FIG. 4 and FIG. 5 are transverse cross sections through barriers prior to their being wetted and put into use. When in dry condition, the barriers have interior cavities 33, 35, the vertical dimensions of which are exaggerated for illustration. In the most compact flattened condition of a barrier, an interior cavity will have a very small cross sectional area and associated volume, at least equal to the area/volume of the absorbent contained therein A barrier of the present invention may have different shapes and different internal constructions. In one embodiment, shown in FIG. 5 and FIG. 8, a barrier 120 has single interior cavity 133 and during use is preferably oblong cross section structure, optionally round. In another embodiment, shown in FIGS. 1 to 4, barrier 20 is divided lengthwise so there is a front cavity and a rear cavity. The front and rear portions are mostly referred to here as lobes.

Figure 4A:
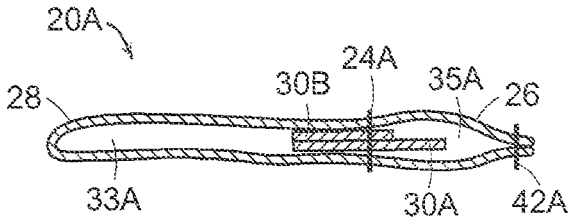
FIG. 4A is like FIG. 4, showing another embodiment of two-lobe barrier in dry condition where the water-absorbent sheet is doubled, i.e., two layered.
Figure 4B:
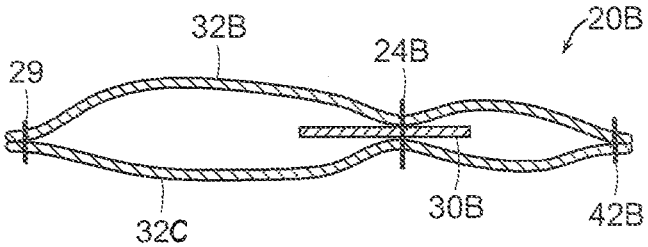
FIG. 4B is like FIG. 4, showing another embodiment of two lobe barrier in dry condition where the sleeve is comprised of two separate sheets of material, stitched at three locations.

More particularly, barrier 20 of FIGS. 1 to 4 comprises a fabric sleeve 32 which defines a front lobe 28 and a rear lobe 26, the lobes being separated by lengthwise fastening means 24 of the sleeve. The lengthwise ends are closed, as by fastening, sufficiently to prevent escape of the absorbent before and after wetting. Barrier 20 may be made of a flat sheet of material by folding it upon itself and fastening it, preferably by thread stitching, to form an essential flattened tube. Other fastening means may be used. For instance, thread-stitching, staples, adhesives and heat sealing (of a preferred thermoplastic geotextile fabric) may be used. The ends of the sleeve are closed by stitching or one or more of the other foregoing means. Other means for making the two-lobe barrier may be used, including forming the front and rear lobe separately before attaching them to each other. In FIG. 4B an embodiment of barrier 20B is formed by stitching two pieces of fabric 32B and 32C together at front stitching 29 and rear stitching 42B and lobe-dividing stitching 24B which captures sheet 30B, compared to folding one piece of fabric upon itself as in FIG. 4.

As can be appreciated from FIG. 3, in use a barrier embodiment is subjected to the lateral force FW of the dammed water 16. The force FW of the water tends to cause overturn or rolling of the barrier, as well as tending to cause translation of the barrier across the surface 19 of earth 18. The weight of the water-soaked absorbent increases frictional engagement of the barrier with the support surface 19, to resist the lateral force FW which would slide the barrier across the surface. Water also "wants" to follow a leak path under the barrier, namely, at the interface 40 between the bottom 50 of the front lobe 28 of the barrier and the surface of the earth. There is an analogous leak path or thin gap 41 at the rear lobe 26.

Exemplary barrier 20 is provided to the user in dry condition. As such it is in a compact and generally flat condition, as illustrated by FIG. 4. In this invention an absorbent is a substance which has the property, upon contact with sufficient water, of expanding greatly in volume, for instance, at least 20 times, preferably at least 30 and up to 60 or more times its original volume. Thus, the average transverse dimension of the barrier cross section, or a subdivision of same, loosely analogous to the diameter of a cylinder, increases accordingly. As illustrated in FIG. 3, that makes the barrier effective for containing water 16 nominally up to depth equal to the maximum height DF of the barrier.

Figure 8:
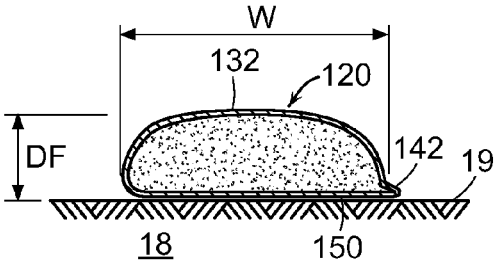
FIG. 8 is a cross section view of a one cavity barrier on a support surface, showing the flattened bottom and nominal D-shape cross section.

The amount of absorbent per unit length of barrier is selected to make the barrier have a cross section with height, i.e. DF, sufficient to achieve its dam-function. But preferably, the amount of absorbent is selected so that its swelled volume is less than the maximum possible interior volume of the sleeve or a subdivision thereof. A reason for this is explained with reference to FIG. 5 and FIG. 8, which show exemplary single lobe barrier 120. FIG. 5 shows how barrier 120 expands from its dry condition to its expanded condition 120P shown in phantom. In its fully wetted, and swelled or expanded condition, as best illustrated in FIG. 8, barrier 120 has an intentionally imperfectly rounded cross section. Thus, as shown in FIG. 8, the cross section of the swelled up barrier will approximate a D-shape, with the long straight side of the "D" lying along the surface 19. That means the width dimension W is substantially greater than the height dimension D, and importantly, the less-than-maximum filling with absorbent enables sleeve 32 to assume a shape (i.e., the D-shape) having a lesser volume per unit length than the volume per unit length which would characterize a fully swelled and nominally round cross section barrier.

The partial filling and resultant nominal D-shape means that a substantial portion of the surface of the bottom 150 of barrier 120 will be in contact with the surface 19 of the earth 18. That provides a longer and therefore more flow-resistive leak path for water which seeks to flow under the barrier. The front lobe of the two-lobe barrier behaves in analogous fashion. Loosely, there is a labyrinth type seal under the barrier.

An exemplary two-lobe barrier 20 may be formed by taking an about 48 cm (19 inch) wide strip of fabric of a desired length, for instance 1.5 meter (5 feet), is folded upon itself and stitched lengthwise at the rear to form a sleeve which is 1.5 meter (5 feet) long by about 23+ cm (9+ inch) wide in its dry condition. When swelled up, the width of the front lobe will be about 15 cm (6 inches) and the width of the rear lobe will be about 5 cm (2 inches). The front lobe will be about 7.6 cm (3 inches) high and the rear lobe will be about 3.8 cm (1.5) inches high.

An exemplary single lobe barrier 120 may be formed by taking an about 76 cm (30 inch) wide sheet which is about 0.6 meter (2 feet) long and folding it and stitching it at one place and the ends, to form a barrier which is about 38 cm (15 inches) wide in dry condition and about 30 cm (12 inches) wide in swelled up condition. The flattened portion 150 will be about 25 cm (10 inches) long. Thus about one-third (25 cm divided by 76 cm) of the peripheral exterior surface of the barrier sleeve is in contact with the support surface.

Figure 6:
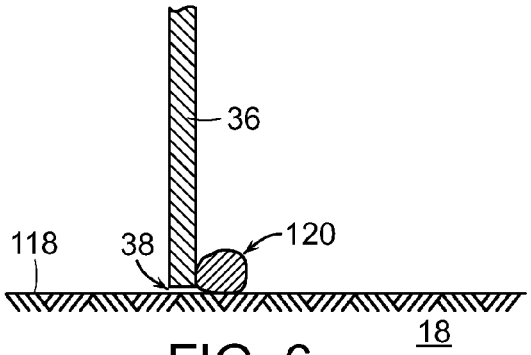
FIG. 6 is a side elevation cross section view of a barrier resting against the bottom of a door to a structure.

As mentioned above. The translation force FW s resisted by frictional engagement of the sleeve at the bottom of the barrier with the surface of the earth. Other means may be used to hold a barrier in place. For example, the ends of a barrier may be fastened to structures such as parts of buildings or trees or pins driven into the soil. Anchors or dead weights may be spaced apart along the length of the barrier. In one mode of use, illustrated in FIG. 6, a barrier 120 (or barrier 20) is placed along the bottom of a door 36, such as an overhead garage door, to stop water from infiltrating the typically small gap 38 where the door meets the garage floor 118. In such case, the force or water will press the barrier against the door 36. Alternately, the barrier may be spaced apart from the door so that the user outside the building may observe if water is flowing under the barrier and take remedial action.

The two-lobe construction makes a barrier better than a plain generally tubular barrier, in resisting the pressure of dammed water 16, pictured as resolved vector FW in FIG. 3, which tends to roll or overturn the barrier. When there is a force FW, contact of rear lobe 26 with the earth surface results in an upward resisting force FU being applied at contact point 34. See FIG. 3. That force is transmitted through the two-layer fabric joint 23 between the lobes, where is located lengthwise stitching 24. Force FU results in a moment which counteracts the moment caused by force FW. Thus, from one viewpoint, the rear lobe can be conceived as providing a lever arm, also called moment arm, which prevents rotation.

Preferably, the front lobe is substantially larger than the rear lobe. One reason is that it is undesirable for cost and engineering reasons to allocate absorbent to the rear lobe beyond that necessary to provide the "lever arm" which resists the rolling; and, it is preferable to concentrate absorbent in the front lobe since the greater volume means more height of barrier.

In an example of the invention, when a two lobe barrier is swelled up the barrier weighs almost 10.4 kg per meter (7 pounds per linear foot); the front lobe will weigh about 9-10 kg per m (6-7 pounds per linear foot) and the rear lobe will weigh about 1.5 kg per meter (1 pound per linear foot). The relative volumes are in the same proportions, namely between 6 to 1 and 6.7 to 1. Generally, in preferred two lobe embodiments, about 80-90 percent of the weight of the barrier is in the front lobe and 10-20 percent of the weight of the barrier is in the rear lobe. Having about those proportions is important because it balances the need to maximize the size (and thus the height) of the front lobe to protect against the deepest water flow possible, while on the other hand, it is desirable to make the rear lobe large enough to adequately perform its function of providing a lever arm sufficient to resist the lateral overturning force of water accumulated against the front face of the barrier. In accord with the examples given here, a two lobe barrier may have a front lobe which is about 60-80 percent, preferably about 70 percent of the total width of the barrier. Notwithstanding the preferences, in other embodiments of the invention the front and rear lobes may be less disproportionate or equal in sizing. In the generality of the invention there may be more than two lobes and there may be channels interconnecting the front and rear lobes.

Figure 7:
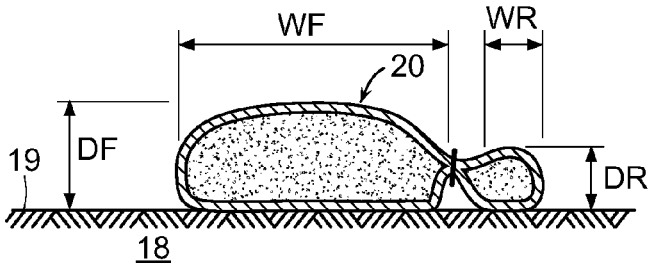
FIG. 7 is a side elevation cross section view of a two lobe barrier resting on a support surface, showing the flattened bottom of the barrier.

FIG. 7 shows some exemplary proportions of the cross section of a two lobe barrier 20 in its swelled and use condition: The front lobe height DF is about 8 cm (3¼ inch); the width WF is about 10-13 cm (4-5 inch). The rear lobe height DR is about 3 cm (1¼ inch) and the width WR is about 3.8 to 5 cm (1½ to 2 inch).

Figure 10:
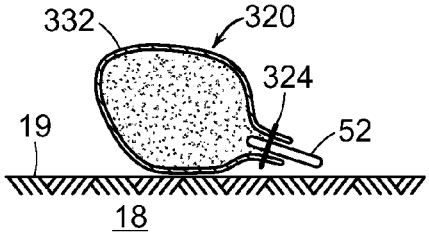
FIG. 10 is a cross section view of a barrier having a rear projecting portion, for preventing rolling of the barrier.

FIG. 10 shows the cross section of a barrier 320 which has an effective lever arm that resists rotation, similar to the effect achieved for barrier 20. A stiff plastic strip 52, for instance a 0.6 cm (¼ inch) thick by 5 cm (2 inch) strip of high density polyethylene or polypropylene, is captured within the ends of sleeve 332 and fastened to it stapling 324, sewing or another alternate fastening means, as described above. When there is a horizontal force applied to the front of the barrier, or some other rolling force is applied, the rearmost edge of the strip contacts the surface of the earth and prevents rotation.

In the generality of this aspect of the invention, a projection is formed at the rear of a barrier, sufficient in dimension to engage the support surface and to resist rotation of the barrier. The projecting means may be spaced apart or continuous along the length of the barrier. Other means may be used to form a rotation resisting structure, including such as attaching a stiff lengthwise member like a tube or bar to the exterior of the rear of a barrier, bunching up the fabric, and so forth.

Figure 9:
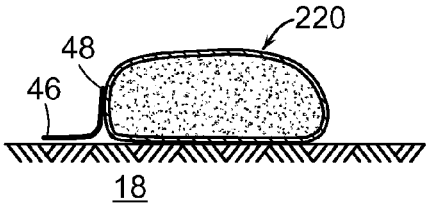
FIG. 9 is a view like FIG. 9 showing a barrier having an apron attached to the front.

FIG. 9 shows another embodiment barrier 220, the body of which has a cross section like barrier 120. Lengthwise-extending apron 46 is fastened to the front 48 of the barrier. It is preferably is made of water impermeable material such as plastic sheet. Due to the weight of water overlying apron 46 during use, apron 46 will both tend to inhibit flow under the barrier and help hold down the front end of the barrier to thereby resist rolling force. Apron 46 may also be applied to a two-lobe barrier. See the apron called a flap in Smith U.S. Pat. No. 7,762,842, the disclosure of which is hereby incorporated by reference.

Prior to use, the absorbent contained within the sleeve of a barrier is essentially dry and only a small interior volume is needed to contain the absorbent and any associated carrier sheet or pouch, etc. That enables the barrier to be stored and shipped in a compact flat or folded condition. Preferably the barrier will be within a closed flexible plastic sheet container, also referred to as a bag or envelope, as discussed below in connection with FIG. 13.

To put a barrier in condition for full use, the absorbent must be contacted with water sufficient to cause it to expand substantially. This may be done in any manner, including in one or more exemplary modes: (a) the user sprays water on the barrier or wets it by submersion at the time of placement; (b) rain wets the barrier after placement; and (c) surface water approaches and infiltrates the in-place barrier.

At the time of manufacture, dry absorbent 22 is placed within the sleeve. In one preferred approach, the absorbent is contained within a sheet 30 comprised of cellulose, and one or more layers of sheet 30 are positioned within an interior cavity of the sleeve. FIG. 4 shows a single sheet 30 and FIG. 4A shows two sheets 30A, 30B. In both examples the sheets are captured in place by lengthwise fastening 24 which also defines the boundary between the front and rear lobe cavities. So placing the cellulosic sheet insures correct distribution of absorbent between the front and rear lobes and along the length of the barrier.

In another approach of carrying out the invention, absorbent is placed as a powder within the sleeve and the user takes care to ensure proper distribution along the length at the point of use by shaking and manipulation.

In another approach, the absorbent is a powder which is contained within one or more spaced apart water soluble pouches, or in a water soluble tube running lengthwise, where both the pouches and the tube are contained within the sleeve, and are optionally stitched, stapled or otherwise held in location. Water soluble absorbent containers may be made in accord with the teachings of Kataoka U.S. Pat. No. 6,524,670, the disclosure of which hereby is incorporated by reference in its entirety.

The absorbent for the barrier may be a so-called super absorbing polymer (SAP), generally a hydrogel. SAP is familiar in commerce, for instance in the fabrication of diapers for babies, feminine care pads, meat pads, and other commercial water absorbing devices. A familiar SAP is comprised of polymerized acrylic acid in combination with sodium hydroxide, with an initiator, forming sodium polyacrylate when wetted. The resultant mass is gelatinous. As known in the technical literature, other materials may be used for SAP, including polyacrylamide copolymer, ethylene maleic anhydride copolymer, cross-linked carboxymethylcellulose, polyvinyl alcohol copolymers, cross-linked polyethylene oxide, and starch grafted copolymer of polyacrylonitrile. See also the teaching of Watanabe et al. U.S. Pat. No. 7,258,904, the disclosure of which is hereby incorporated by reference.

The extent to which any SAP expands on contact with water can vary with the quality of the water, e.g., its purity, salinity, hardness, etc., and other parameters. To achieve certain objects of the invention, for instance to achieve the desired D-shape of a swelled barrier, a presumption or forecast is made of the nature of the water with which the barrier will be contacted. In this description the objects of the invention, and the particulars of the invention, will be realized, understood and interpreted when water has the character of water familiar in northeastern U.S. lakes, water courses, and municipal water supplies.

Less preferable absorbents which may be used comprise corn cob, hair, fur, cellulose, cotton, sponge, clay, diatomaceous earth and mixtures thereof. Because they have lesser swelling volume and weight gain than SAP they are less preferred. One or more of the foregoing absorbents and SAP may be used in combination with each other. See the foregoing Watanabe patent for other absorbents which may be used.

In an example of a two-lobe barrier, the sleeve before swelling will be about 23 cm (9 inch) wide and from about 1.5 to 3 to 5 meter (5 to 10 to 17 feet) in length in the dry condition. Upon swelling, an exemplary two lobe barrier may have the dimensions mentioned in connection with FIG. 3 and FIG. 7. The barrier may be fabricated by means of a commercially available cellulosic sheet within which is incorporated a water-absorbent substance, in the manner shown in FIG. 4. A representative sheet may contain about 300 gram per square meter of SAP. Upon being soaked, the sheet releases the SAP so it can move about within the interior cavity containing the sheet. As mentioned, doubling, or placing one sheet 30B layer upon a first sheet 30A, shown in FIG. 4A for barrier 20A, may be used to achieve the requisite amount of SAP with a sleeve.

Cellulose is preferred for the sheet material that carries the absorbent because it is water soluble. Other known water soluble materials may be used. In an alternate embodiment, the carrier sheet might be comprised of non-soluble substance, provided the sheet is of a character that allows the SAP to escape and or disperse throughout the sleeve of the barrier. In a further alternate embodiment, the SAP is integrated with another substance to form a composite sheet. In the generality of this aspect of the invention, the absorbent is contained within a sheet or comprises part of a sheet. A dimpled sheet may have the absorbent blended with the cellulose; alternately, the sheet comprises a top and a bottom layer of cellulose-only material between which is a cellulose-absorbent blend.

The SAP loading will be allocated between the front and back lobes, and in total will be that which is likely to produce the desired dimensions of a barrier when contacted with sufficient water. In one of foregoing exemplary two-lobe barriers, there will be about 85 grams of SAP absorbent per linear meter (26 grams per linear foot). When the absorbent is expanded by infiltration of water, the barrier may have a weight of about 10 kg per linear meter (7 pounds per linear foot), compared to a dry weight of about 0.2 kg per linear meter (0.14 pounds per linear foot). Thus, the weight of the absorbent with water is about 50 times more than the dry weight of the absorbent. In the generality of the invention, an absorbent greatly swells when it expands in volume at least 20 times.

In another example of barrier, the sleeve will be about 38 cm (15 inches) wide and 0.6 meter (2 feet) in length in the dry condition and will comprise a single interior cavity. About 148-207 ml (5-7 ounces) by volume (about 5.5 to 6.3 ounces by weight) of loose particulate SAP absorbent will be present. When wetted, a barrier will have an expanded height of about 9-10 cm (3.5 to 4 inches), a volume of 900+ cubic inches, and a weight of about 14.5 kg (32 pounds), compared to a dry weight of about 0.27 kg (0.6 pounds). In the wet condition, the barrier will be nominally 0.6 meter (2 feet) long by about 30 cm (12 inch) wide.

In embodiments of the invention, the fabric of the sleeve is a non-woven plastic polymer material. A fabric useful for the sleeve is a commercial material comprising needle-punched nonwoven polypropylene textile weighing about 92 grams per square meter (2.7 ounces per square yard) and having a thickness of about 3 mm (0.012 inches). Other non-woven fabrics such as Dupont™ spunbonded polypropylene fabric may be used. Commercial fabrics which are often buried in soil for drainage and filtration purposes, familiarly called geotextiles, may be used. Useful geotextiles have permittivity as measured by ASTM 4491 standard in the range 1-2 seconds$^{-1}$. Other kinds of commercial porous fabrics made from polyolefins other than polypropylene may be used provided the fabric has sufficient porosity to enable water to infiltrate the interior of the barrier in easy fashion. On the other hand, the effective sizing of the porosity for a useful fabric will be small enough to prevent significant escape of the gelatinous mass of the preferred swelled up SAP under normal use.

As the data and examples presented herein show, the preferred non-woven fabrics do not elongate substantially when the SAP expands within an exemplary barrier, i.e., the elongation is no more than about 4 percent. Preferably, the sleeve material has the property of inhibiting the passage of sunlight, i.e., in particular ultraviolet rays, which in experiments have been found to degrade certain common SAP absorbents, as described below.

Figure 11:
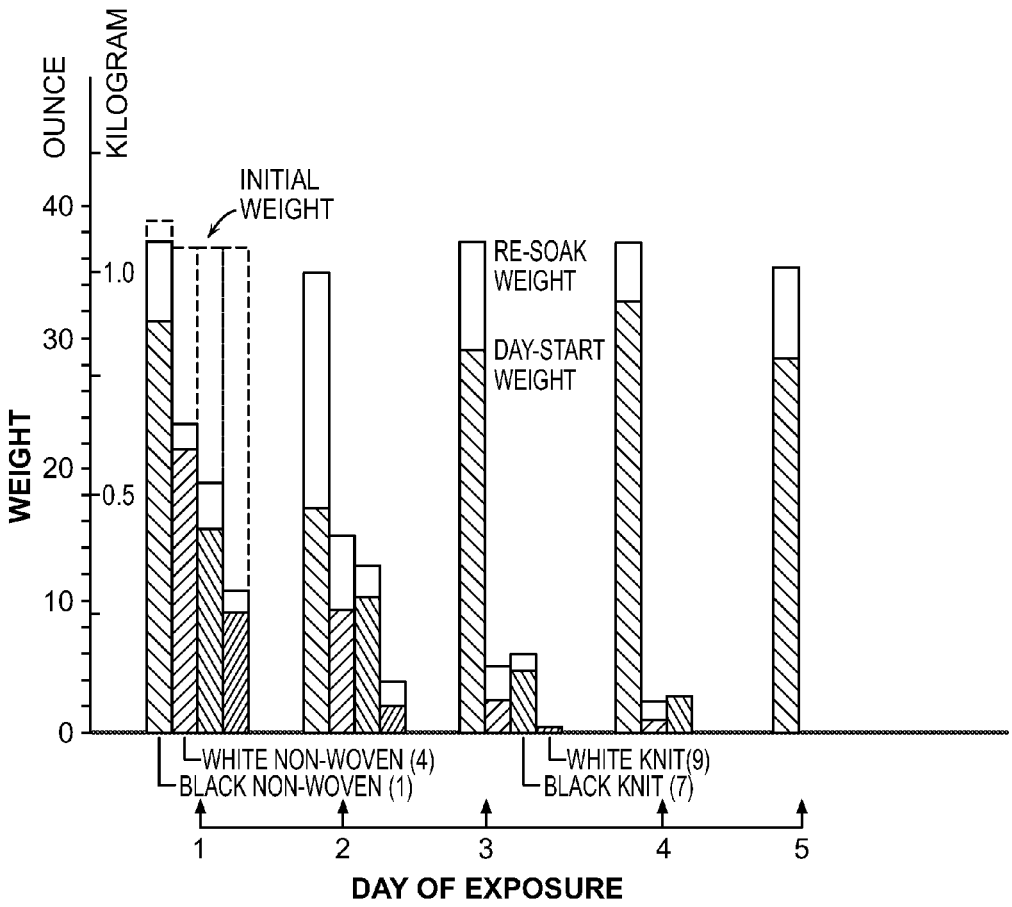
FIG. 11 is a bar chart showing the change in weight of barrier specimens comprised of different fabrics when exposed to sunlight.
Figure 12:
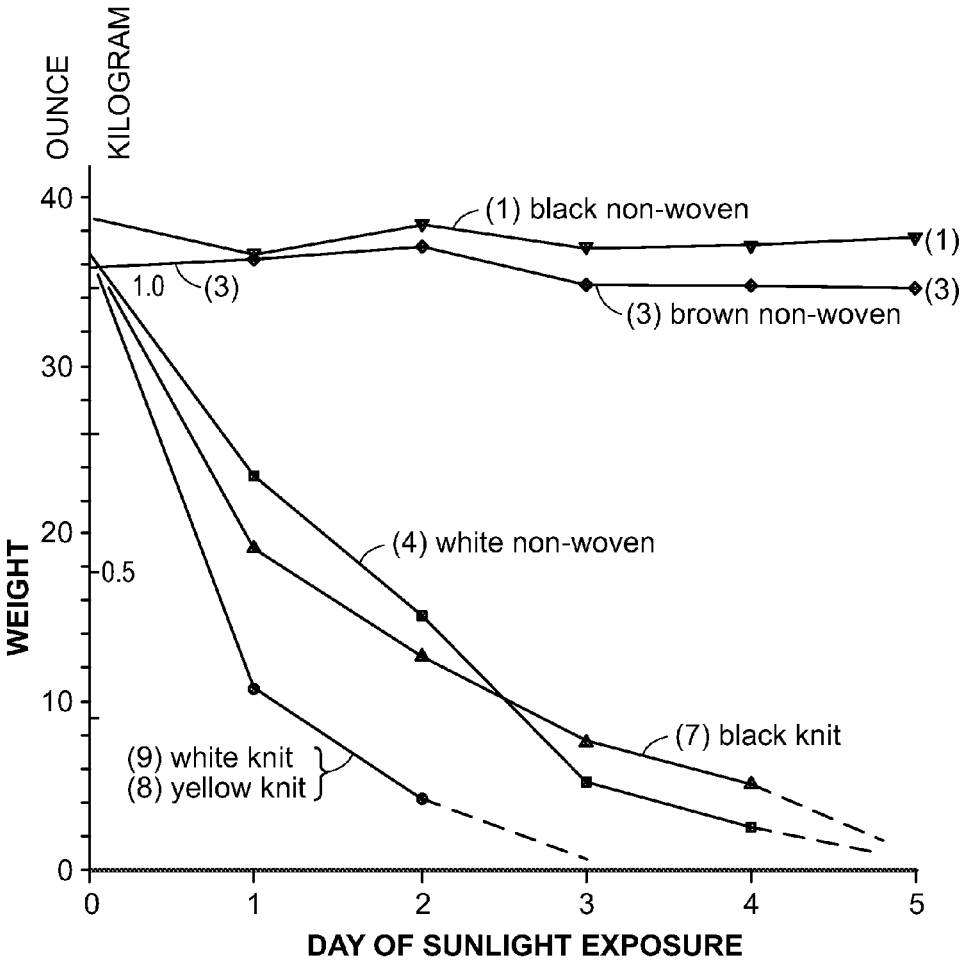
FIG. 12 is a line chart showing the change in weight of barrier specimens comprised of different fabrics when exposed to sunlight over sequential days.

Table 1 shows experimental data which was obtained by exposing test specimens to ordinary New England (nominally 41.7 degrees of latitude) summer sunlight, with estimated 60-80 percent relative humidity and 70-80 degree Fahrenheit daytime conditions over a number of days. FIG. 11 is a bar chart showing some of the data from Table 1. FIG. 12 is a line chart showing other data. The Table and Figures show the comparative performance of different materials, gaged by weight. The test specimens were rectangular flat sleeves of about 13 by 25 cm (5 by 10 inch) dimension, each containing about 20 grams of dry SAP (0.7 ounces). On Day 0, the start of the test period, each specimen was soaked with water. This is called the "start condition" of the test specimen. The SAP absorbed water and the specimen swelled up.

Each specimen was then laid on a flat surface so it was exposed to the sun during the day. On the following morning, each specimen was weighed. The each was re-soaked by immersing it in water for about three minutes; and weighed again. This pattern was repeated until the first of either when a specimen became wasted away and essentially non-functional, or the test was terminated.

Specimens 1-3 comprised needle punched polypropylene nonwoven fabric of about 0.3 mm (12 mils) thick, from different sources. Specimens 4-6 comprised spunbonded polypropylene fabric of about 0.3 mm (12 mils) thick, from a source. Specimen 6 was made of UV resisting polypropylene, according to the manufacturer. (As the data show, this specimen behaved a little better than Specimen 1 and Specimen 2, which were not represented as having special UV-resisting properties.) Specimens 7-10 comprised knit fabric made of polyester fiber. The fabric was comprised of about half 150 denier black and half 100 denier natural polyester fiber.

It can be seen from the Table and FIG. 11 that every specimen lost some weight during a day, and then upon re-soaking the next morning, it re-gained weight. To the extent a specimen maintained or regained weight, it indicates the extent to which a similarly made barrier would maintain its functionality. A high percentage of weight retention by a specimen indicates that a full size barrier will maintain its desired swollen and effective shape.

It can also be seen that several of the specimens progressively lost weight from one day to the next, at both the first weighing and the re-soaked weighing. This is attributed to deterioration in the water absorbing and water holding property of the SAP. The SAP deterioration is attributed to sunlight exposure; it is presumed that ultraviolet (UV) wavelength radiation is the dominant causative part of the spectrum.

TABLE 1

Test data for 5 × 10 inch (nominal 13 × 25 cm) specimens exposed to sunlight on successive days. Weight is in kilograms. Specimens were weighed and then re-soaked and weighed at the start of each day.

| No. | Fabric | Condition | Day 0 | 1 | 2 | 3 | 4 | 5 | 8 | 9 | 10 |
|---|---|---|---|---|---|---|---|---|---|---|---|
| 1 | Nonwoven NP-A | Day-start weight | 1.12 | 0.66 | 0.87 | 0.81 | 0.80 | 0.86 | 0.64 | 0.89 | 0.89 |
| | Black | Re-soak weight | | 1.02 | 1.08 | 1.03 | 1.06 | 1.07 | 1.03 | 1.08 | 1.08 |
| | | % retained wt | | 92% | | 92% | | 96% | | | |
| 2 | Nonwoven NP-B | Day-start weight | 1.09 | 0.60 | 0.86 | 0.75 | 0.72 | 0.67 | 0.24 | NF | |
| | Black | Re-soak weight | | 1.03 | 1.04 | 0.97 | 0.97 | 0.96 | 0.45 | | |
| | | % retained wt | | 95% | | 89% | | | | | |
| 3 | Nonwoven NP-C | Day-start weight | 1.02 | 0.58 | 0.78 | 0.72 | 0.71 | 0.73 | 0.59 | 0.82 | 0.82 |
| | Brown | Re-soak weight | | 0.92 | 0.98 | 0.94 | 0.98 | 0.98 | 0.93 | 1.01 | 1.01 |
| | | % retained wt | | | | 95% | | 96% | | | |
| 4 | Nonwoven SB | Day-start weight | 1.04 | 0.62 | 0.27 | 0.07 | 0.02 | NF | | | |
| | White | Re-soak weight | | 0.67 | 0.42 | 0.15 | 0.06 | | | | |
| | | % retained wt | | | | 19% | | — | | | |
| 5 | Nonwoven SB | Day-start weight | 1.10 | 0.90 | 0.47 | 0.84 | 0.93 | 0.80 | 0.55 | 0.77 | 0.74 |
| | Black | Re-soak weight | | 1.09 | 1.00 | 1.07 | 1.07 | 1.01 | 0.93 | 1.02 | 1.00 |
| | | % retained wt | | | | 98% | | | | | |

TABLE 1-continued

Test data for 5 × 10 inch (nominal 13 × 25 cm) specimens exposed to sunlight on successive days. Weight is in kilograms. Specimens were weighed and then re-soaked and weighed at the start of each day.

| No. | Fabric | Condition | Day 0 | 1 | 2 | 3 | 4 | 5 | 8 | 9 | 10 |
|---|---|---|---|---|---|---|---|---|---|---|---|
| 6 | Nonwoven SB | Day-start weight | 1.06 | 0.85 | 0.64 | 0.90 | 0.98 | 0.92 | 0.64 | 0.83 | 0.82 |
| | UV Black | Re-soak weight | | 1.09 | 1.00 | 1.10 | 1.11 | 1.09 | 1.08 | 1.04 | 1.03 |
| | | % retained wt | | | | 103% | | 103% | | | |
| 7 | Knit | Day-start weight | 1.05 | 0.48 | 0.29 | 0.20 | 0.12 | 0.08 | | | |
| | Black | Re-soak weight | | 0.53 | 0.35 | 0.22 | 0.14 | NF | | | |
| | | % retained wt | | | | 21% | | | | | |
| 8 | Knit | Day-start weight | 1.06 | 0.29 | 0.10 | 0.03 | | | | | |
| | Yellow | Re-soak weight | | 0.33 | 0.15 | NF | | | | | |
| | | % retained wt | | | | — | | | | | |
| 9 | Knit | Day-start weight | 1.04 | 0.26 | 0.06 | 0.01 | | | | | |
| | White | Re-soak weight | | 0.30 | 0.12 | NF | | | | | |

NF = test terminated, specimen not functional

Day 1 in the Table shows data taken 24 hours after the initial wetting and the start of the initial about 8 hr exposure to daytime sunlight. In the bar chart of FIG. 11, the upper end of a cross hatch segment of a vertical bar shows the weight of the specimen at the start of each day, after having been exposed to sunlight the prior day. The upper end of the uncross hatched segment of a vertical bar shows the weight of the same specimen after re-soaking in the morning.

Even within the context of small test sample size and probable variability/error in data, conclusions can be drawn. FIG. 11 and Table 1 illustrates that the black nonwoven specimen No. 1 suffered relatively little degradation, losing only about 4-8 percent of the initial weight up to exemplary Day 5. The white nonwoven specimen No. 4 lost almost all its weight and became non-functional at day 5. While the black knit specimen No. 7 outperformed white knit specimen No. 9, both knit specimens were degraded to non-functionality on Day 4. Yellow knit specimen No. 8 was only slightly better than the poorly performing white knit; it also was non-functional on Day 4.

The inferiority of the knit fabric specimens is believed to be due in good part to the tendency of the knit/woven fabric pores to visibly "open up" when there is swelling of contained absorbent substance and resultant strain of the fabric. This leads to a conclusion that a non-woven fabric is particularly advantageous because on a comparative basis it does not substantially stretch or elongate under the forces generated by swelling SAP, and thus there is not an increase in pore size.

FIG. 12 and the tabular data show that brown nonwoven No. 3 is comparable to black nonwoven No. 1, in that both lost about 4 percent weight, i.e., comparing the Day 5 re-soak weight to the initial weight. Both black and brown are very much superior to all of white nonwoven, black knit, white knit and yellow knit. The brown fabric was dark brown. Black and white are considered to be colors for purpose of this application. Thus, in one approach, the invention is defined as comprising a sleeve which is made of dark color non-woven fabric/fiber. Of course, dark brown defines a yellow-orange hue which is has a low value, using terminology of the Munsell color system. Other dark color fabrics are reasonably deduced to work comparably to black and brown. Thus, in another approach to defining the invention, the preferred barrier material is a non-woven fabric made of a fiber which has any hue and a value of 2 or less on the Munsell color system scale, where value ranges from 1 to 10.

The foregoing discovery of the dependency of barrier performance and life on hue and value of the fabric means that the new barriers of the present invention are particularly useful compared to barriers which might be constructed in accord with the teachings of the prior art which made no distinction with respect to structure or color, insofar as durability is concerned.

Thus, a barrier within the scope of this aspect of the invention includes a barrier is comprised of a water permeable fabric which is one or more of (a) comprised of black or brown fiber; (b) non-woven and comprised of polyolefin fiber; and (c) comprised of fabric which, when formed into a 13 by 25 cm (5 inch by 10 inch) envelope specimen containing about 20 milliliters (0.7 ounces) of SAP that is repetitively soaked at the start of each day and is exposed to sunlight over a period of 3 days, enables the specimen to maintain more than 80 percent of its initial soaked weight; preferably 90 percent over 5 days. A preferred fabric has the property of preventing substantial degradation in performance of a barrier, in particular of the absorbent material contained therein, when the barrier has been substantially exposed to sunlight. Such kind of substantial exposure to sunlight comprises at least three repetitive 8 hour exposures of an initially soaked barrier having the size and shape of the foregoing test specimen to dry air and mid-Summer sunlight at 41.7 degrees of latitude in northern hemisphere, each 8 hour exposure followed by 16 hour of rest, then by re-soaking of the barrier. By substantial degradation is meant that a barrier specimen, having been substantially exposed to sunlight as aforesaid, degrades in water absorbing and holding capacity to the extent that the barrier weighs less than 80 percent of the barrier specimen weight in the start condition, wherein the start condition is the weight of the specimen after the initial soaking at the start of the test. As a corollary, an absorbent which substantially degrades is an absorbent capable of absorbing 20 or more times its weight in water and substantially losing its original water absorbing capacity—losing 20 percent or more, upon exposure to 24 hours of said sunlight.

When the barrier is comprised of the preferred fabrics, a barrier may be dried over time after its use for damming or channeling water has ceased, to effect a collapse to near its original condition. The barrier may then be stored for re-use at a later date.

If the life of a barrier is not an important criterion, and in the generality of the invention, less preferred fabrics, including the white or yellow or knit fabrics mentioned above may be used in combination with the other features of the invention. A knitted/woven fabric of jute or cotton or other material fiber may be used. Likewise, in still other embodiments of the invention, the sleeve may be a common plastic thermoplastic sheet, e.g., polyethylene or some other polyolefin, with a multiplicity of punched perforations which reasonable experimentation shows are sufficiently small to contain the absorbent when it expands. What is a useful permeability for a barrier may vary with the nature of the SAP or other absorbent which is used, and with the time which the maker thinks is acceptable for water to infiltrate into the interior of the barrier.

Figure 13:
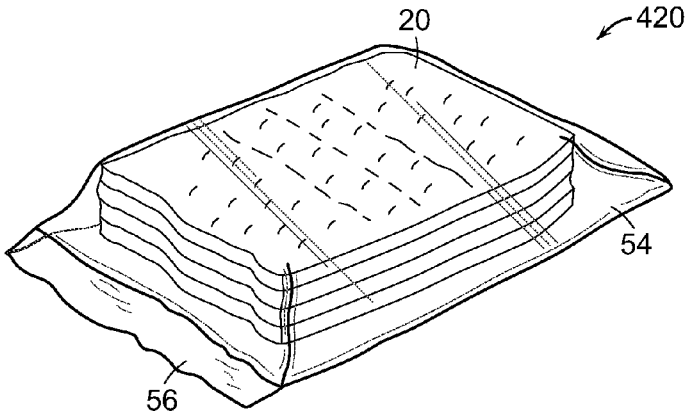
FIG. 13 shows a barrier in combination with a flexible sealed plastic container.

When the SAP is contained within a newly manufactured barrier, it is of course desirable to keep it from accidental contact with water. It is also desirable to have it in as compact a form as possible for economic shipment and storage. In fulfillment of these aims, as illustrated by FIG. 13, in a preferred embodiment, a barrier 20 is combined with a flexible plastic sheet container 54 to form a packaged barrier assembly 420. The container may be made of polyethylene, vinyl, and other commonly familiar packaging material. The barrier is shown as it has been folded to fit within an imaginary rectanguloid space, for example within an about 12×20×5 cm (5×8×2 inch) or 25×20×5 cm (10×8×2 inch) rectanguloid, and then sealed in a plastic pouch.

Preferably, the container, also called a bag or an envelope, is shaped so that it is only somewhat larger than the folded bag, i.e., sufficient to enable easy insertion thereof. Preferably, during the process of sealing of the container 54, part of the air within is evacuated. Known packaging technology may be used including that which is referred to as vacuum sealing or vacuum packing. When so packaged, there will be sub-atmospheric pressure air, alternately some other gas, within the container. Thus, the surrounding atmosphere exerts a compacting force on the container which is transmitted to compress the folded barrier, leading to higher density of assembly. This makes for more compact storage and packing for shipment than otherwise would be the case. The packaging also keeps the barrier from inadvertent contact with moisture prior to use. To use the sub-atmospherically packaged barrier, a consumer will tear or cut the seal 56 of the container, allowing air to enter, and the consumer will then remove and unfold the barrier. In carrying out this aspect of the invention, a barrier may be rolled up as a cylinder shape and packaged in a container; and the term "folded" in the claims shall encompass such rolling.

An exemplary 5 meter (17 foot) long barrier which is about 23+ cm (9+ inches) wide from front to back in its dry and flat condition is comprised of about 0.3 mm (0.012 inch) thick fabric and two SAP strips of about 2 mm (0.080 inch) thick is reduced to a package of about 33×23×6 cm (13×9×2.4) inches thick weighing about 0.7 kg (1½ pounds), using one mode of vacuum packaging. When such a barrier is contacted with water and is in full use condition, it will weigh about 52 kg (115 pounds).

The invention may also be used in the following way: A sports field has standing water, i.e., ponding, as may result from rain gathering in slight depressions on the field, which inconveniences the sportspeople or others who are present. Such standing water can be removed by placing an article constructed like one of the unused aforementioned articles, such as a simple rectangular envelope onto the surface of the pond, allowing it to absorb the pond water. The article is then picked up from the spot where it was laid, and carried away, thus removing all or part of the water.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A barrier, for use in resisting the passage of surface water when laid upon a surface, having a length and a width wherein the length is substantially greater than the width, and containing a water absorbent substance which when contacted by water swells many-times in volume to form a gelatinous mass, thereby causing the barrier to change from a first as-fabricated configuration to a second swelled-configuration, the barrier comprising:

a sleeve, made of water-permeable fabric for containing said water-absorbent substance when swelled, having a front lengthwise-running end, a spaced apart rear lengthwise-running end, a sleeve top, and a sleeve bottom, said top and bottom each connecting said front end with said rear end;

first fastening means running lengthwise along the sleeve and connecting the sleeve top to the sleeve bottom at a location intermediate said front end and said rear end, the location biased toward the rear end, the first fastening means thereby dividing the sleeve into a front lobe and a rear lobe, each lobe having an interior cavity and an associated volume, wherein each interior cavity runs along the length of the barrier;

at least one sheet comprised of said water absorbent substance captured within the sleeve by said first fastening means, the sheet having a first fractional portion extending into the interior cavity of the front lobe and a second smaller fractional portion extending into the interior cavity of the rear lobe;

wherein when in said swelled configuration, the front lobe has a volume which is substantially larger than the volume of the rear lobe.

2. The barrier of claim 1 further comprising a second sheet comprised of said water absorbent substance, lying parallel to the at least one first sheet and likewise captured by said first fastening means.

3. The barrier of claim 1 wherein, when the barrier is in swelled configuration the front lobe has weight which is about 80-90 percent of the total weight of the barrier.

4. The barrier of claim 3 wherein the barrier is in swelled configuration comprises a front lobe which is 60-80 percent of the width of the barrier.

5. The barrier of claim 3 wherein, when the barrier is in swelled configuration, the front lobe has a cross section transverse to the length of the sleeve which is D-shape; and, wherein the straight portion of the D-shape comprises the bottom of the sleeve.

6. The barrier of claim 1 wherein, when the barrier is in swelled configuration, the front lobe has a cross section transverse to the length of the sleeve which is D-shape; and, wherein the straight portion of the D-shape comprises the bottom of the sleeve.

7. The barrier of claim 1 wherein the water-absorbent substance comprises a super absorbent polymer having the property of swelling in volume by at least twenty times upon contact with water.

8. The barrier of claim 1 wherein the at least one sheet is comprised of the water-absorbent substance and cellulose material as a second substance.

9. The barrier of claim 1 wherein the sleeve comprises a piece of fabric having opposing ends and a fold running in the sleeve lengthwise direction, the fold located at the front end of the sleeve and between the two opposing ends of said piece of fabric, the two opposing ends of said piece of fabric positioned adjacent each other at the rear end of the sleeve; further comprising, second fastening means running lengthwise along the rear end of the sleeve to hold together the ends of said piece of fabric.

10. The barrier of claim 1 further comprising a lengthwise-running apron attached to the front end of the barrier.

11. The barrier of claim 1 wherein said sleeve fabric is a non-woven material, the color of which is black or brown and has a value of 2 or less on the Munsell color system scale.

12. The barrier of claim 10 wherein said sleeve fabric is a needle punched polymer or a spunbonded polyolefin.

13. A barrier, for use in resisting the passage of surface water when laid upon a surface, having a length and a width wherein the length is substantially greater than the width, and containing a water absorbent substance which when contacted by water swells in volume by at least twenty times upon contact with water to form a gelatinous mass, thereby causing the barrier to change from a first as-fabricated configuration to a second swelled-configuration, the barrier comprising:

a sleeve, made of water-permeable fabric for containing said water-absorbent substance when swelled, having a front lengthwise-running end, a spaced apart rear lengthwise-running end, a sleeve top, and a sleeve bottom, said top and bottom each connecting said front end with said rear end;

first fastening means running lengthwise along the sleeve and connecting the sleeve top to the sleeve bottom at a location intermediate said front end and said rear end, the first fastening means thereby dividing the sleeve into a front lobe and a rear lobe, each lobe having an interior cavity and an associated volume;

at least one sheet comprised of said water absorbent substance captured within the sleeve by said first fastening means, the sheet having a first fractional portion extending into the interior cavity of the front lobe and a second smaller fractional portion extending into the interior cavity of the rear lobe;

wherein when in swelled up condition, the front lobe has a substantially larger volume than the volume of the rear lobe;

wherein, when the barrier is in swelled configuration the front lobe has a volume which is 60-90 percent of the total of the volumes of the front lobe and the rear lobe, the front lobe is 80-90 percent of the weight of the barrier, and the front lobe has a cross section transverse to the length of the sleeve which is D-shape.

* * * * *